US005173655A

United States Patent [19]

Conzelmann et al.

[11] Patent Number: 5,173,655

[45] Date of Patent: Dec. 22, 1992

[54] CURRENT REGULATOR

[75] Inventors: Gerhard Conzelmann, Leinfelden-Oberaichen; Gerhard Fiedler, Neckartailfingen, both of Fed. Rep. of Germany

[73] Assignee: Robert Bosch GmbH, Stuttgart, Fed. Rep. of Germany

[21] Appl. No.: 679,056

[22] PCT Filed: Oct. 21, 1989

[86] PCT No.: PCT/DE89/00670

§ 371 Date: May 1, 1991

§ 102(e) Date: May 1, 1991

[87] PCT Pub. No.: WO90/05330

PCT Pub. Date: May 17, 1990

[30] Foreign Application Priority Data

Nov. 2, 1988 [DE] Fed. Rep. of Germany ..... 3837215
Oct. 6, 1989 [DE] Fed. Rep. of Germany ..... 3933433

[51] Int. Cl.[5] ..... G05F 1/565

[52] U.S. Cl. ..... 323/285; 323/282; 323/351

[58] Field of Search ..... 323/282, 285, 264, 284, 323/299, 316, 349, 351

[56] References Cited

U.S. PATENT DOCUMENTS 4,028,564 6/1977 Streit et al. ..... 307/310
4,712,169 12/1987 Albach ..... 323/282 X
4,849,683 7/1989 Flolid ..... 323/285 X

*Primary Examiner*—Emanuel T. Voeltz
*Attorney, Agent, or Firm*—Frishauf, Holtz, Goodman & Woodward

[57] ABSTRACT

A current regulator, preferably constructed in accordance with monolithic integrated technology, for high currents is proposed, whose output current (I) is a function of an input quantity (E). In this case the output current (I) is less in a range of the input quantity (E) different from a value of zero than the value given in this range by the functional relationship between the input quantity (E) and the output current (I).

9 Claims, 1 Drawing Sheet

CURRENT REGULATOR

FIELD OF THE INVENTION

Figure 1:
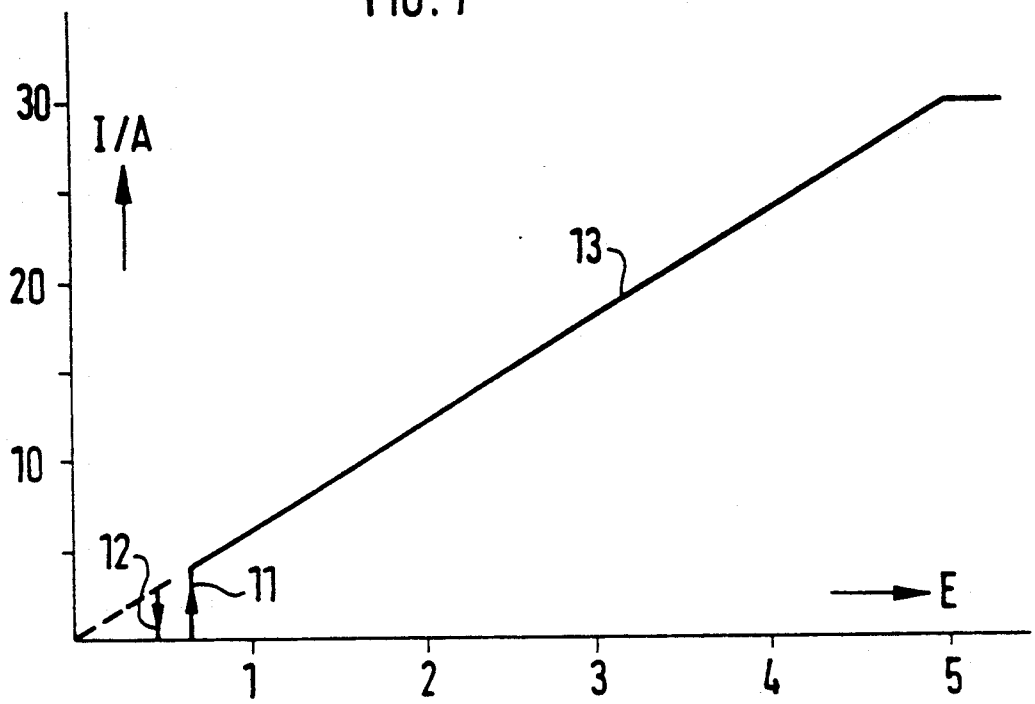

The present invention relates generally to a current regulator and, more particularly, to a transistorized regulator circuit which incorporates a comparator.

BACKGROUND

Current regulators for higher currents, whose output current is a function of an input quantity, are hard to control in respect to their dynamic stability because of the great steepness and the resulting high amplifications of open collector stages. High-frequency oscillations over the entire range of the operating current under all conditions of use are hard to prevent, in particular in connection with rapidly operating regulators, which are intended for universal use and as a consequence may be connected with the operational voltage, the control device and the consumer via cable harnesses of different length.

Because the transition frequency of transistors is reduced with lowering current density, it would be required to make the upper limit frequency of the positive feedback loop for the range located in the vicinity of the output current "zero" lower than for the range of higher currents However, variable limit frequencies require increased circuit outlay.

From the textbook by Winfried Oppelt, "Kleines Handbuch technischer Regelvorgaenge" [Brief Manual of Technical Regulation Processes], published by Verlag Chemie GmbH, Weinheim [Fed. Rep. of Germany], Vol. 5, 1972, as well as from French patent document FR-A-2 336 841, non-linear regulators are already known, whose describing function or transfer function has a dead zone in the range around the zero point.

From German patent document DE-A-1 513 127 a circuit arrangement for avoiding error functions of an electrical main circuit is furthermore known, which prevents the switching on of a main circuit prior to the required supply voltage having been reached. For this purpose a control and amplifier unit is placed upstream of the main circuit which only switches on the main circuit after a required supply voltage has been reached. From the article by Claude Boisard entitled "Un CI regulateur de vitesse pour moteur a courant continu a aimant permanent" [A Printed Circuit Speed Control for a Constant Current Motor with a Permanent Magnet] in the magazine "Electronique Industrielle et Microelectronique (EMI)", No. 162 of Oct. 15, 1972, pp. 57 to 60, a speed control for an electric motor with a permanent magnet is furthermore known, which contains in the motor excitation circuit an npn-end stage transistor whose emitter is connected to a negative supply voltage. In this case an operational amplifier is placed upstream of the npn-end stage transistor for switching the npn-end stage transistor on and off as a function of a control quantity and a reference voltage.

Furthermore, from FIG. 4 of German Letters Patent DE-PS 21 47 179 and corresponding U.S. Pat. No. 4,028,564, a current regulator in accordance with the species of the main claim is known, identified there as a controllable current source, which is designed for low output currents.

OBJECT, ATTAINMENT OF OBJECT AND ADVANTAGES OF THE INVENTION

It is the object of the invention to screen out the low currents in a current regulator and designed for high currents.

In this connection, it is particularly advantageous if the output of the comparator is connected with the output of the operational amplifier via the collector-base-section of an auxiliary npn transistor whose emitter is connected to ground.

In a further development of the invention, the comparator may be a comparator with hysteresis. By means of this, it is attained that the output current of the current regulator, in the current consuming range with falling input voltage, is switched off at a lower value of the input voltage than that at which it is switched on.

DRAWINGS

The invention will be described by means of FIGS. 1 and 2.

Figure 2:
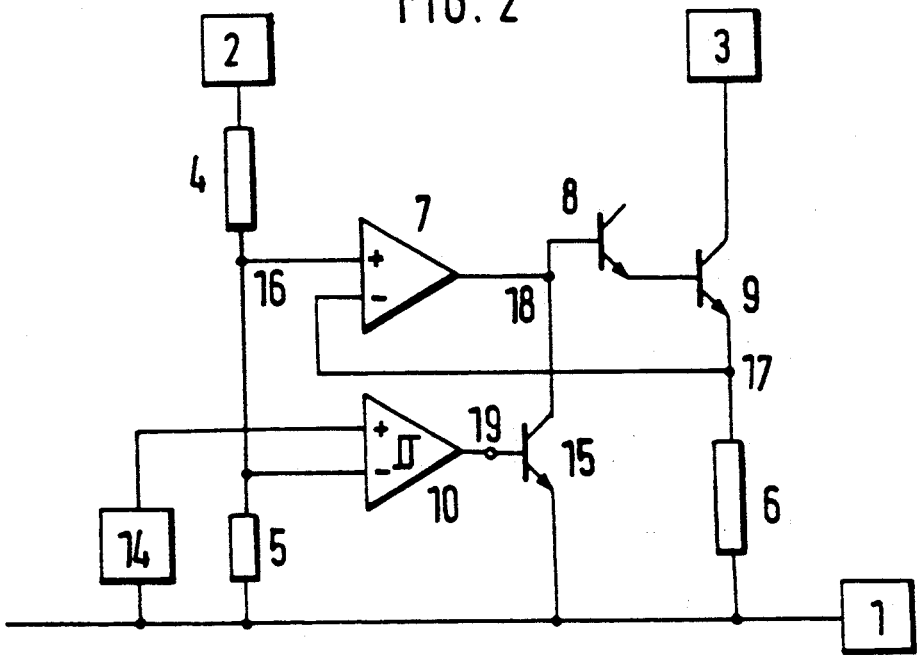

FIG. 1 shows the transfer characteristic curve, and FIG. 2 is a block diagram of the current regulator.

DESCRIPTION OF THE INVENTION

The transfer characteristic curve 13 of the output current I of a current regulator for nominal I =30 A is shown in FIG. 1 as a function of an input quantity E with five units. A linear relationship was assumed for the sake of simplicity. The input quantity E may be an externally supplied electrical voltage or an electrical current; however, it may also be generated, for example in the case of a monolithically integrated current regulator, in the interior of the circuit itself, such as by temperature for a temperature regulator with a cooling blower or even by other quantities, such as mechanical stresses, a luminous flux or the like. In a linear relationship between output current and input quantity as in this example, the range wherein the output current is zero can be defined by the output current or the input quantity. But because the output current is decisive in connection with dynamic instability, it is advantageous to define this range also by means of the output current.

In the present example the output current is only switched on by an input quantity after, starting at zero, it has resulted in a current value of approximately 4 A at 11; correspondingly, with a falling input quantity the output current is switched off only when the current value at 12 falls below approximately 3 A. This hysteresis is required to create defined relationships and to prevent oscillations around the switch point in this way. Furthermore, when switching on, it is necessary to adapt the speed of increase of the output current in the customary way to the conditions, which is possible without effecting the upper limit frequency of the regulating circuit. A current value of up to approximately 20% of the maximum output current has proven advantageous for the switch-on point, with a hysteresis of approximately 50% to 80% of this value. The closer the output current approaches the value "zero" at the switch-on point, the more critical the dynamic stability of the current regulator becomes or the lower its upper limit frequency needs to be placed. Therefore the subject of the invention is particularly advantageous for rapid current regulators with short transition times, especially for monolithically integrated circuits, because in this case the use of frequency-lowering capacitances requires large chip surfaces.

In the block diagram of FIG. 2, the ground connection is designated with 1, the input of the current regulator with 2 and the output with 3. Furthermore, the resistors 4 and 5 form a voltage divider with the connecting point 16 for adaptation of the transfer characteristic curve to the required input voltage range, 6 is the precision resistor for the output current; 7 is the operational amplifier in the control circuit with its output 18. A transistor, connected downstream as emitter follower for additional current amplification, is designated with 8 and the power or end stage transistor with 9. The positive input terminal of the operational amplifier 7 is connected to the point 16 of the resistance divider, the negative one to the point 17 of the precision resistor 6; with this the control circuit is closed. The illustration of steps for attaining dynamic stability has been omitted.

The section 11, 12 of the transfer characteristic curve is reached by means of the comparator 10 with hysteresis, whose negative input terminal is also connected with the input voltage (terminal 16) and whose positive input connector is connected with a reference voltage 14. It is also possible to employ a Schmitt trigger in place of the comparator 10 with reference voltage 14. The output of the comparator 10 is connected with the base of a transistor 15, whose collector acts on the output 18 of the operational amplifier 7.

If the input potential 16/1 (potential of the connector 16 with respect to ground 1) is less than the reference voltage 14, the output 19 of the comparator is high, a transistor 15 receives base current, its collector pulls the output 18 of the operational amplifier 7 towards the ground potential, the transistors 8, 9 do not receive base current, the output current remains at zero until the potential 16/1 becomes greater than that of 14; from this point on, the comparator 10 reverses, its output 19 goes towards ground potential, the transistor 15 is without current and in this way makes possible the control of the end stage amplifier, transistors 8, 9.

The subject of the invention is a circuit for screening out a section, bordering "zero", of the transfer characteristic curve of a current regulator for relatively high output currents. Because these regulators tend to be dynamically unstable on account of the current density-dependent transition frequency of the power transistors, particularly in connection with low currents, it is advantageous to screen out the range of the non-required low currents.

The aim, to make the current regulator dynamically stable for cable harnesses arbitrarily located in a motor vehicle, can be attained in this way with a reduced circuit requirement, which lowers the cost, particularly in connection with monolithically integrated circuits. Furthermore, in this way, a possibly existing offset voltage of the operational amplifier and a potential offset possibly present at the input are eliminated.

We claim:

1. A current regulator containing an npn-end stage power transistor (9), having a base, an emitter and a collector, and whose emitter (17) is connected to ground (1), where a precision resistor (6) for the output current of the current regulator is provided in an emitter supply line of the end stage transistor (9) and where the base of the end stage transistor (9) is connected with the output (18) of an operational amplifier (7), whose inverted input is connected with the emitter (17) of the end stage transistor (9) and whose non-inverted output is connected with the positive input voltage (E) of the current regulator, characterized in that for the employment of the regulator for high output currents and with the use of a power transistor as end stage transistor (9), a comparator (10) is provided which is connected with its non-inverted input with a reference voltage (14), with its inverted input with the positive input voltage (E) of the current regulator and with its output (19) coupled with the output (18) of the operational amplifier (7) in such a way, that the end stage transistor (9) is switched off in a range of the positive input voltage (E) which differs from zero.

2. A current regulator in accordance with claim 1, characterized in that the output (19) of the comparator (10) is connected with the output (18) of the operational amplifier (7) via the collector-base-section of an auxiliary npn-transistor (15) whose emitter is connected to ground (1).

3. A current regulator in accordance with claim 1, characterized in that the comparator (10) is a comparator with hysteresis.

4. A current regulator in accordance with claim 1, wherein, given a predetermined range of input voltage (E) and a corresponding predetermined range of output current (I), said power transistor (9) is controlled to be non-conductive for a low portion of said input voltage range, corresponding essentially to a lowest 20% of said output current range, so that actual output current in said low portion is less (12) than current values extrapolated along a characteristic line (13) from higher portions of said input voltage range.

5. A current regulator in accordance with claim 4, wherein for input voltage values above said non-conductive range of said power transistor (9), there is a substantially linear characteristic relation (13) between input voltage and output current.

6. A current regulator in accordance with claim 4, wherein when input voltage falls, said power transistor becomes non-conductive at a switch-off voltage value (12) lower than a switch-on voltage value (11) at which said power transistor becomes conductive, when input voltage is rising.

7. A current regulator in accordance with claim 6, wherein a value of the output current at the switch-off voltage value is not greater than 80% of the value of the output current at the switch-off voltage value.

8. A current regulator in accordance with claim 6, wherein a value of the output current at the switch-off voltage value is approximately 50% to 80% of the value of the output current at the switch-on voltage value.

9. A current regulator comprising an input terminal (2);

a power transistor (9) having an emitter-collector path connected between a ground terminal (1) of the regulator and an output terminal (3) of the regulator;

an operational amplifier (7) having two inputs (16, 17), one of which is coupled to said input terminal (2); and a comparator (10), having first and second input terminals, said first input terminal being connected to a reference voltage (14), and said second input terminal being connected to one (16) of said inputs of the operational amplifier (7);

means (15) for controlling conduction of said power transistor (9) as a function of output voltages of said operational amplifier (7) and comparator (10), thereby defining a control loop;

said control loop operating in such a way that the power transistor (9) is switched off in a range of positive input voltages, at said input terminal (2), which differs from zero but borders zero.

* * * * *